US012138684B2

(12) United States Patent
Hartmann et al.

(10) Patent No.: US 12,138,684 B2
(45) Date of Patent: Nov. 12, 2024

(54) APPARATUS AND METHOD FOR PRODUCING A STRIP USING A RAPID SOLIDIFICATION TECHNOLOGY, AND A METALLIC STRIP

(71) Applicant: Vacuumschmelze GmbH & Co. KG, Hanau (DE)

(72) Inventors: Thomas Hartmann, Büdingen (DE); Robert Schulz, Frankfurt (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

(21) Appl. No.: 18/118,223

(22) Filed: Mar. 7, 2023

(65) Prior Publication Data

US 2023/0201918 A1 Jun. 29, 2023

Related U.S. Application Data

(62) Division of application No. 17/177,677, filed on Feb. 17, 2021, now Pat. No. 11,660,666.

(30) Foreign Application Priority Data

Feb. 19, 2020 (DE) ..... 10 2020 104 310.4

(51) Int. Cl.
*C22C 45/02* (2006.01)
*B22D 11/00* (2006.01)
(Continued)

(52) U.S. Cl.
CPC ..... *B22D 31/002* (2013.01); *B22D 11/001* (2013.01); *B22D 11/0611* (2013.01); *B22D 11/12* (2013.01)

(58) Field of Classification Search
CPC ..... C22C 45/00; C22C 45/02; B22D 11/001; B22D 11/0611; B22D 11/12; B22D 31/002
(Continued)

(56) References Cited

U.S. PATENT DOCUMENTS 4,588,015 A 5/1986 Liebermann
4,793,400 A 12/1988 Wood
(Continued)

FOREIGN PATENT DOCUMENTS

CN 101218045 A 7/2008
CN 101678443 A 3/2010
(Continued)

OTHER PUBLICATIONS

Qiang, "Metal Material Science," Metallurgical Industry Press, Sep. 2016, with statement of relevance, 5 pages.
(Continued)

*Primary Examiner* — Kevin P Kerns
(74) *Attorney, Agent, or Firm* — Dickinson Wright PLLC

(57) ABSTRACT

A method for producing a strip using a rapid solidification technology is provided. A melt is poured onto a moving outer surface of a rotating casting wheel, the melt is solidified on the outer surface and a strip is formed. A gaseous jet is directed at the moving outer surface and the outer surface of the casting wheel is worked with the jet. The jet comprises $CO_2$ and at least part of this $CO_2$ strikes the moving outer surface of the casting wheel in a solid state.

5 Claims, 2 Drawing Sheets

(51) Int. Cl.

| | |
|---|---|
| ***B22D 11/06*** | (2006.01) |
| ***B22D 11/12*** | (2006.01) |
| ***B22D 31/00*** | (2006.01) |

(58) Field of Classification Search
USPC ..... 148/403; 164/158, 463
See application file for complete search history.

(56) References Cited

U.S. PATENT DOCUMENTS

| | | | |
|---|---|---|---|
| 4,881,989 | A | 11/1989 | Yoshizawa et al. |
| 5,043,029 | A | 8/1991 | Liebermann et al. |
| 5,307,861 | A | 5/1994 | Townsend |
| 5,651,413 | A | 7/1997 | Williams et al. |
| 6,749,700 | B2 | 6/2004 | Sunakawa et al. |
| 8,083,867 | B2 | 12/2011 | Yoshizawa et al. |
| 9,053,847 | B2 | 6/2015 | Zhou et al. |
| 9,700,937 | B2 | 7/2017 | Schulz |
| 11,660,666 | B2 * | 5/2023 | Hartmann et al. .. B22D 11/0611 164/158 |
| 2003/0041931 | A1 | 3/2003 | Sunakawa et al. |
| 2008/0223542 | A1 | 9/2008 | Marti et al. |
| 2009/0065100 | A1 | 3/2009 | Yoshizawa et al. |
| 2010/0132907 | A1 | 6/2010 | Ozaki et al. |
| 2014/0104024 | A1 | 4/2014 | Herzer et al. |

FOREIGN PATENT DOCUMENTS

| | | | |
|---|---|---|---|
| DE | 4241342 | A1 | 6/1993 |
| DE | 102010036401 | A1 | 1/2012 |
| EP | 3089175 | A1 | 11/2016 |
| GB | 2262434 | A | 6/1993 |
| JP | H03165955 | A | 7/1991 |
| JP | H03169460 | A | 7/1991 |
| JP | H0819834 | A | 1/1996 |
| JP | 2008279459 | A | 11/2008 |
| WO | 2007/031135 | A1 | 3/2007 |
| WO | 2013/132777 | A1 | 9/2013 |

OTHER PUBLICATIONS

Wang et al., "Overview of Carbon Dioxide Snow Cleaning Mechanism and Development," Science and Technology Vision, Issue 21, 3 pages.
"Snow Jets [Schneestrahlen]," with machine translation, Wikipedia, Sep. 7, 2019, 3 pages.
"Compressed Air Jets [Druckluftstrahlen]," with machine translation, Wikipedia, Feb. 19, 2016, 2 pages.
"Dry Ice Blasting [Trockeneisstrahlen]," with machine translation, Wikipedia, Jan. 12, 2020, 4 pages.
Lengerer, "Effective, surface cleaning with CO2 Snow," with machine translation, Advanced Clean Production, Nov. 15, 2007, 19 pages.

* cited by examiner

APPARATUS AND METHOD FOR PRODUCING A STRIP USING A RAPID SOLIDIFICATION TECHNOLOGY, AND A METALLIC STRIP

This U.S. patent application is a divisional of U.S. patent application Ser. No. 17/177,677 filed Feb. 17, 2021, now U.S. Pat. No. 11,660,666, which claims priority to German patent application 10 2020 104 310.4, filed on Feb. 19, 2020, the entire contents of which are incorporated herein by reference for all purposes.

BACKGROUND

Technical Field

The invention relates to an apparatus for producing a strip using a rapid solidification technology, a method for producing a strip using a rapid solidification technology, and a metallic strip.

Related Art

It is desirable for economic reasons to be able to produce thin, rapidly solidified metal strips in large, continuous strip lengths without the strip tearing off during the production process and without the quality of the strip deteriorating over the duration of the casting process. Due to the thermo-mechanical load on the casting wheel during strip production, however, a continual disintegration of the casting track surface of the casting wheel starts within the first few kilometres of strip being produced, resulting in non-homogeneous strip quality with a deterioration in roughness and so a reduction in various characteristics including the lamination factor of the strip.

To produce the longest possible continuous strip lengths of consistent quality, in a known process the surface of the casting track is worked simultaneously with strip production in order to maintain the quality of the surface for as long as possible. This can be achieved by means of material-removing processes, such as polishing the casting drum, as disclosed in EP 3 089 175 B1, by grinding the drum or by brushing, as disclosed in U.S. Pat. No. 6,749,700 B2. U.S. Pat. No. 9,700,937 B1 discloses an alternative, forming process in which the casting wheel track is continually rolled to smoothen it. Further improvements are however desirable in order to lengthen the service life of the casting track.

SUMMARY

The object is therefore to reliably produce a metal strip with good material quality in long lengths.

According to the invention, a method is provided for producing a strip using a rapid solidification technology in which a melt is poured onto a moving outer surface of a rotating casting wheel, whereby the melt solidifies on the outer surface and a strip is produced. A gaseous jet is directed at the moving outer surface and the outer surface of the casting wheel is worked with the jet. The jet contains $CO_2$ and at least part of this $CO_2$ strikes the moving outer surface of the casting wheel in a solid state.

The invention is based on the new realisation that the process and the methods currently being used to work the casting track of the casting wheel themselves leave residues on the casting wheel that can lead to wetting problems of the melt and to defects in the strip. The use of material-removing methods can leave working residues such as dust, brush hairs and polishing residues on the outer surface of the casting wheel and carry them into the molten metal droplet, where they can cause imperfections. With thicker strips with a strip thickness greater than 20 μm wetting problems of this type may manifest themselves as air or gas pockets on the casting wheel side of the amorphous strip. With thin strips with a thickness of less than 20 μm, in particular, however, these wetting defects can lead to undesirably large holes in the strip, which can form the starting point for tears in the strip. Even when forming methods are used to work the casting wheel surface, it is impossible to exclude the possibility of lubricant from pivot and bearing points reaching the wheel surface, impairing wetting and so causing imperfections in the strip. According to the invention, these residues on the outer surface of the casting wheel are removed with a jet by means of which $CO_2$ in a solid state is accelerated onto the outer surface, this jet being able to remove the residues in order to improve the cleanliness and surface quality of the outer surface. This can reduce the number of imperfections in the strip. It can also increase the production length and ensure a low surface roughness over long strip lengths.

The solid $CO_2$ has the further advantage that it sublimes. This prevents the jet itself from leaving residues on the outer surface. This sublimation also means that residues and other undesirable foreign substances such as lubricants that are present in solid or liquid state on the surface of the casting wheel can also be removed by the sublimation of the $CO_2$ particles striking the surface.

In one embodiment the gaseous jet strikes the outer surface of the casting wheel as the melt is being cast onto the outer surface of the rotating casting wheel. This means that the outer surface can be worked and cleaned inline and before each contact with the melt. This embodiment can be used in methods in which the outer surface is worked using a material-removing and/or forming process as the melt is poured onto the outer surface.

In one embodiment the casting wheel moves in a direction of rotation. The gaseous jet strikes the outer surface of the casting wheel at a first position which, when viewed in the direction of rotation, is arranged upstream of a second position at which the melt strikes the outer surface. When viewed in the direction of rotation, this first position is arranged downstream of the point at which the strip detaches from the casting wheel. The outer surface is thus worked and cleaned with the jet after the strip has detached from the outer surface but before the melt strikes this region of the outer surface again.

One or more jet nozzles may be provided through which the jet or jets are directed onto the outer surface of the casting wheel so as to direct the jet spatially in order to work a predetermined region of the outer surface.

In one embodiment it is possible to set a gap between the jet nozzle and the outer surface of the casting wheel so as to set the intensity with which the gaseous jet strikes the outer surface of the casting wheel.

In one embodiment a $CO_2$ source comprising dry ice particles is provided and the dry ice particles are accelerated onto the outer surface to form the gaseous jet. These dry ice particles can be prefabricated. As they are being accelerated onto the outer surface, they may partially sublime such that the jet comprises $CO_2$ gas in addition to the dry ice particles.

The dry ice particles can have an average particle size of 0.1 μmm to 10 μmm. The dry ice particles can have corners that may also have a material-removing or forming effect on the outer surface.

In one embodiment the dry ice particles are accelerated onto the outer surface of the casting wheel with a carrier gas. The pressure of the carrier gas may be adjustable.

In one embodiment the gaseous jet also contains further particles of a further material. These additional particles therefore contain a material other than $CO_2$ and can be selected to have a different effect.

The particles may also be of different size and/or shape to the dry ice particles, if present. The particles may be spherical and/or rounded, while the dry ice particles are angular, for example. The particles may have a greater hardness than the dry ice particles so as to better remove any residues present on the outer surface. For example, the particles may be ceramic beads and/or glass beads. The particles may have an average diameter of 10 μm to 1 μmm.

In one embodiment a $CO_2$ source comprising liquid $CO_2$ is provided as the jet. Particles, i.e. $CO_2$ in a solid state, crystallise out of this liquid $CO_2$ to form a $CO_2$ snow that strikes the outer surface of the casting wheel as a $CO_2$-containing jet that comprises $CO_2$ in both gaseous and $CO_2$ snow form. As a result of this process, the particles that crystallise out of the liquid $CO_2$ are typically spherical. The particles of $CO_2$ show have an average particle size of 0.1 μm to 100 μm.

In one embodiment the particles of $CO_2$ snow are accelerated onto the outer surface of the casting wheel without an additional carrier gas in the $CO_2$ gas flow.

In an alternative embodiment the particles of $CO_2$ snow are accelerated onto the outer surface of the casting wheel with a carrier gas. The pressure of the carrier gas may be adjustable.

In one embodiment, irrespective of the type of solid $CO_2$, the outer surface is also formed or worked using a material-removing process with a surface-working means at a third position. When viewed in the direction of rotation, this third position is arranged upstream of the first position at which the gaseous jet strikes the outer surface of the casting wheel, but downstream of the point at which the strip detaches from the casting wheel. As a result, the outer surface is worked first with the surface-working means and then with the $CO_2$ jet and it is therefore possible to remove residues from both the casting and strip production processes and the surface-working means using the jet containing solid $CO_2$ particles.

The surface-working means may comprise one or more devices capable of working the outer surface one after another. The surface-working means can work the outer surface either by the removal of material or by forming.

A rolling device that is pressed against the outer surface of the casting wheel as the casting wheel rotates may be provided as the forming surface-working means. In this context, the terms "formed" and "forming" should be interpreted as referring to the redistribution of material. The rolling device is not used with the intention of removing material from the outer surface, as can be achieved with a brush, for example. No chips and almost no abrasion dust or other debris that might have a negative effect on the metal strip production process are produced.

A polishing device that is pressed against the outer surface of the casting wheel as the casting wheel rotates and/or a grinding device that is pressed against the outer surface of the casting wheel as the casting wheel rotates and/or one or more brushes that are pressed against the outer surface of the casting wheel as the casting wheel rotates may be provided as the material-removing surface-working means.

The brushes can also have a cleaning effect and neither abrade nor form the outer surface.

In one embodiment the surface-working means is pressed against the outer surface of the casting wheel so as to continuously smoothen the outer surface of the casting wheel as the melt is cast onto the outer surface of the casting wheel. This embodiment can be used for the rolling device.

In one embodiment the gaseous jet strikes the moving outer surface of the casting wheel and the surface-working means is pressed against the moving outer surface of the rotating casting wheel before the melt is cast onto the outer surface of the casting wheel. This embodiment can be used to prepare the outer surface prior to the casting process.

In one embodiment the surface-working means is a rolling device and the rolling device is pressed against the outer surface of the casting wheel so as to form the outer surface of the casting wheel.

In some embodiments two or more surface-working means are used, when viewed in the direction of rotation their positions being arranged upstream of the position at which the gaseous jet strikes the outer surface of the casting wheel but downstream of the point at which the strip detaches from the casting wheel.

Where a material-removing and a forming surface-working means are used, in one embodiment the material-removing surface-working means is used upstream of a forming surface-working means when viewed in the direction of rotation.

As already described above, it is possible to use two or more jets containing $CO_2$ and for at least part of this $CO_2$ to strike the moving outer surface of the casting wheel in a solid state.

In one embodiment an additional gaseous jet that strikes the surface of the rotating casting wheel downstream of the material-removing surface-working means and upstream of the forming surface-working means is used in addition to the jet at the first position. This additional gaseous jet contains $CO_2$ and at least part of this $CO_2$ strikes the moving outer surface of the casting wheel in a solid state. This additional jet may have the properties according to any one of the embodiments described here. For example, the jet may comprise dry ice particles or $CO_2$ snow from a liquid $CO_2$ source and may be directed or accelerated against the outer surface with or without a carrier gas.

The melt and thus the strip can have different compositions. In one embodiment the melt consists of:

$Fe_{100-a-b-w-x-y-z}\ T_a\ M_b\ Si_w\ B_x\ P_y\ C_z$ (in at %), T denoting one or more of the elements in the group consisting of Co, Ni, Cu, Cr and V, and M denoting one or more of the elements in the group consisting of Nb, Mo and $T_a$, where $0 \le a \le 70$ $0 \le b \le 9$ $0 \le w \le 18$ $5 \le x \le 20$ $0 \le y \le 7$ $0 \le z \le 2$.

The melt and so the strip may also contain up to 1 at % impurities.

The solidified strip is normally at least amorphous and can be heat treated in a further process in order to produce a nanocrystalline strip. The heat treatment can also be used to set the properties, e.g. the magnetic properties, of the strip.

For example, the solidified amorphous strip can consist of at least 80% by volume amorphous material. The nanocrystalline strip may contain at least 80% by volume nanocrystalline grains and an amorphous residual matrix, at least 80% of the nanocrystalline grains having an average grain size of less than 50 nm and a random orientation.

According to the invention, an apparatus is provided for producing a metal strip using a rapid solidification technology. The apparatus comprises a rotating casting wheel with an outer surface onto which the melt is cast, the melt solidifying on the outer surface, a metal strip being formed, and means for directing a $CO_2$-containing jet onto the outer surface of the casting wheel, wherein the jet comprises $CO_2$ and at least part of this $CO_2$ strikes the moving outer surface of the casting wheel in a solid state so as to work and/or clean the outer surface of the casting wheel with the jet.

The means for directing the $CO_2$-containing jet can be a nozzle by means of which it is possible to determine the spatial direction of the jet such that the jet strikes the outer surface of the casting wheel, in particular a desired point on the outer surface of the casting wheel.

In one embodiment the apparatus also has a nozzle system for forming the jet. The design of the nozzle system can be adapted to the type of $CO_2$ source.

In one embodiment the $CO_2$ is provided as liquid $CO_2$ and the nozzle system is a nozzle system for liquid $CO_2$. The nozzle system may have a single-substance or a dual-substance nozzle. In embodiments in which a carrier gas is used in addition to the liquid $CO_2$, a dual-substance nozzle can be used.

In an alternative embodiment the $CO_2$ is provided in the form of dry ice particles and the dry ice particles are accelerated onto the outer surface of the casting wheel to form the jet containing solid $CO_2$. For example, the dry ice particles can be formed into a jet with a carrier gas and accelerated onto the outer surface.

In some embodiments the nozzle system can also be connected to a carrier-gas source by means of which the dry ice particles are accelerated onto the outer surface of the casting wheel. For example, the nozzle system may have a gas-tight connector by which it can be connected to a gas bottle.

In some embodiments the nozzle system is designed such that it also processes other solid particles, these other solid particles being accelerated with the dry ice particles onto the outer surface of the casting wheel. These other solid particles contain no $CO_2$ and can be processed with the dry ice particles and the carrier gas by means of gravity, for example, to form a mixed jet. The other solid particles may be ceramic beads and/or glass beads, for example.

In some embodiments the apparatus also has an exhaust system for removing the $CO_2$ gas. It is thus possible to ensure that the atmosphere in the proximity of the apparatus meets the relevant environmental and industrial safety regulations.

In some embodiments the apparatus also has an extraction system for removing the material detached from the outer surface of the casting wheel.

In some embodiments the casting wheel can be moved in a direction of rotation and the means for directing the $CO_2$-containing jet is designed such that the jet strikes the outer surface of the casting wheel at a first position that is arranged upstream of a second position at which the melt strikes the outer surface of the casting wheel when viewed in the direction of rotation. The $CO_2$-containing jet can thus remove residues from the outer surface shortly or immediately before the melt strikes the outer surface. This increases the effect of the jet on the quality of the strip and the surface quality of the casting wheel.

In some embodiments the apparatus also has a surface-working means for forming or material-removing working the outer surface. This surface-working means is arranged at a third position on the casting wheel, when viewed in the direction of rotation this third position being arranged upstream of the first position at which the jet strikes the outer surface, but downstream of the point at which the strip detaches from the casting wheel. Thus, once the strip has detached, the outer surface is worked first with the surface-working means, then with the $CO_2$-containing jet and only then is the melt cast onto the outer surface again. This sequence means that the $CO_2$-containing jet is able to remove both residues from the material-removing working of the outer surface such as particles of the casting wheel itself, polishing agents, etc. and residues from the forming working of the outer surface such as lubricants.

In some embodiments the surface-working means has one or more designs. For example, the surface-working means may be a rolling device that is pressed against the outer surface of the rotating casting wheel as the outer surface of the casting wheel moves and/or a polishing device that is pressed against the outer surface of the rotating casting wheel as the outer surface of the casting wheel moves and/or a grinding device that is pressed against the outer surface of the rotating casting wheel as the outer surface of the casting wheel moves, and/or have one or more brushes that are pressed against the outer surface of the rotating casting wheel as the outer surface of the casting wheel moves.

Where material-removing and forming working methods are used, the outer surface may be worked first with the material-removing working method, then with the forming working method and then with the $CO_2$-containing jet.

In some embodiments the surface-working means is a rolling device that has a rotatable roller and in which the surface of the rotating roller can be pressed against the outer surface of the rotating casting wheel at such a pressure that the outer surface of the casting wheel is formed.

In one embodiment the roller is driven in one direction of rotation and the casting wheel in a second direction of rotation, the first direction of rotation being opposite to the second direction of rotation.

In one embodiment the roller is moved across the outer surface of the casting wheel parallel to the second axis of rotation of the casting wheel so as to make a spiral contact with the outer surface of the casting wheel. It is thus possible to form a casting track of relatively large width and so to produce a strip of relatively large width reliably.

In some embodiments the means for guiding a $CO_2$-containing jet is configured such that, when viewed in the direction of rotation of the casting wheel, the outer surface of the casting wheel is able to provide a technically clean surface that is largely free from organic and inorganic residues from the first position at which the jet strikes the casting-wheel surface to the second position at which the molten metallic mass is cast onto the outer surface of the casting wheel.

In some embodiments the apparatus also has a winder for continuously taking up the solidified strip.

In some embodiments the apparatus also has a casting nozzle for a melt of an alloy from which the melt can be cast onto the outer surface of the casting wheel.

Also provided for is the use of the apparatus according to any one of the preceding embodiments for producing a metallic strip consisting of $Fe_{100-a-b-w-x-y-z}T_aM_bSi_wB_xP_yC_z$ (in at %) and up to 1 at % impurities, T denoting one or more of the elements in the group consisting of Co, Ni, Cu, Cr and V, M denoting one or more of the elements in the group consisting of Nb, Mo and $T_a$ and where $0 \le a \le 70$, $0 \le b \le 9$, $0 \le b \le 9$, $0 \le w \le w$ $18.5 \le x \le 20.0 \le y \le 7$ and $0 \le z \le 2$.

According to the invention, a metallic strip is provided that consists of $Fe_{100-a-b-w-x-y-z}T_aM_bSi_wB_xP_yC_z$ (in at %)

and up to 1 at % impurities, T denoting one or more of the elements in the group consisting of Co, Ni, Cu, Cr and V, M denoting one or more of the elements in the group consisting of Nb, Mo and $T_a$ and where $0 \leq a \leq 70$, $0 \leq b \leq 9$, $0 \leq w \leq 18.5 \leq x \leq 20$, $0 \leq y \leq 7$, $0 \leq z \leq 2$, the metallic strip having at least one surface with an average surface roughness $R_a$ of between 0.05 μm and 1.5 μm.

In one embodiment the surface roughness $R_a$ has a deviation of less than +/−0.2 μm over a production length of at least 5 km, preferably at least 20 km.

The metallic strip may be ductile and amorphous or may be nanocrystalline. The metallic strip is typically amorphous in the cast state and has a structure that is at least 80% by volume amorphous and is heat treated or annealed to produce a nanocrystalline structure from the amorphous strip. The heat treatment conditions depend on composition, desired properties and grain size. The nanocrystalline structure may comprise least 80% by volume nanocrystalline grains and an amorphous residual matrix in which at least 80% of the nanocrystalline grains have an average grain size of less than 50 nm and a random orientation.

The metallic strip has a casting-wheel side that has been solidified on the outer surface of the casting wheel and an opposing, air side that has been solidified in the air. In some embodiments, immediately after it detaches from the casting wheel, the casting-wheel-side surface of the metallic strip is a technically clean surface free from organic and inorganic residues that is reached by the jet containing $CO_2$ in a solid state due to the treatment of the outer surface of the casting wheel.

In some embodiments the metallic strip has a width of 2 μmm to 300 μmm, a thickness of less than 50 μm and a maximum of 50 holes per square metre.

In some embodiments the metallic strip has a width of 20 μmm to 200 μmm and/or a thickness of between 10 μm and 18 μm and/or fewer than 25 holes per square metre, preferably fewer than 10 holes per square metre. In this publication the term "hole" is defined as a hole in the strip with a minimum surface area of 0.1 $\mu mm^2$.

In some embodiments the metallic strip has a structure that is at least 80% by volume amorphous or has at least 80% by volume nanocrystalline grains and an amorphous residual matrix in which at least 80% of the nanocrystalline grains have an average grain size of less than 50 nm and a random orientation, the air side and/or the casting-wheel side having a surface crystallisation percentage of less than 23%.

In some embodiments the air side and/or the casting-wheel side have a surface crystallisation percentage of less than 5%.

The casting-wheel side and the air side of the metal strip have different qualities as a result of the production process and can therefore be recognised in the metal strip produced. The casting-wheel side and the air side of the metal strip can also be distinguished by the naked eye. The air side typically appears to have a metallic shine while the casting-wheel side is more matte.

Surface crystallisation refers to the formation of crystalline grains on the surface of the strip, i.e. within a surface layer of the strip. For example, more than 80% by volume of the crystalline grains in the surface layer have an average grain size of greater than 100 nm.

The average grain size of the crystalline grains in a nanocrystalline metal strip is greater than the average grain size of the nanocrystalline grains in a nanocrystalline metal strip and the two can therefore be distinguished from one another. For example, the crystalline grains in the surface layer may have an average grain size of greater than 100 nm, while the nanocrystalline grains have an average grain size of no more than 50 nm.

The extent or proportion of surface crystallisation can be determined by means of X-ray powder diffractometry using copper Kαradiation. The surface crystallisation proportions specified here are determined as follows. For an amorphous foil, the surface crystallisation proportion is determined by dividing the area under a characteristic reflex of a crystalline phase, i.e. the crystalline phase of the surface crystallisation, by the sum of the area under a halo characteristic of an amorphous phase and the area under of the characteristic reflex of the crystalline phase.

The characteristic reflex of the crystalline phase of surface crystallisation depends on the structure and composition of the crystalline phase. For example, a (400) reflex is used for phases containing silicon if, as is almost always the case here, they are strongly textured in the (100) direction.

Since surface crystallisation is almost always strongly textured in the (100) direction in these cases, the surface crystallisation proportion of a nanocrystalline sample can be determined as follows.

First, the surface portion of a second characteristic reflex characteristic of the nanocrystalline phase is determined.

Then the area under a first characteristic reflex characteristic of the crystalline phase of surface crystallisation is determined. However, this area should be reduced by the portion of the reflex which is contributed by the nanocrystalline phase. This is 20% of the second characteristic reflex for pure iron and 12.8% for Fe3Si. As the exact Si-content is difficult to ascertain, herein 20% is always deducted. In the case of alloys containing silicon this may lead to a slight underestimation of the extent of surface crystallisation.

For a nanocrystalline foil, the surface crystallisation proportion is determined by dividing the area under a first characteristic reflex of a crystalline phase, i.e. the crystalline phase of the surface crystallisation, minus the portion of the reflex contributed by the nanocrystalline phase, by the sum of the area under a second characteristic reflex characteristic of the nanocrystalline phase and the total area under of the first characteristic reflex of the crystalline phase.

For example, for phases containing silicon a (400) reflex is used as the first characteristic reflex of the surface crystallisation and the (220) reflex is used as the second characteristic reflex of the nanocrystalline phase.

If the surface crystallisation is not textured, its extent can be determined on the as-cast amorphous strip only, as described above for amorphous foils. In the nanocrystalline state the extent of surface crystallisation and the extent of the nanocrystalline phase can no longer be distinguished using powder diffractometry by the lack of texture of the surface crystallisation. However, as the surface crystallisation turns into a continuous layer under heat treatment, the extent of surface crystallisation in the nanocrystalline sample is always equal to or greater than that in the amorphous sample.

BRIEF DESCRIPTION OF THE DRAWINGS

Embodiments are explained below with reference to the drawings.

DETAILED DESCRIPTION

Figure 1:
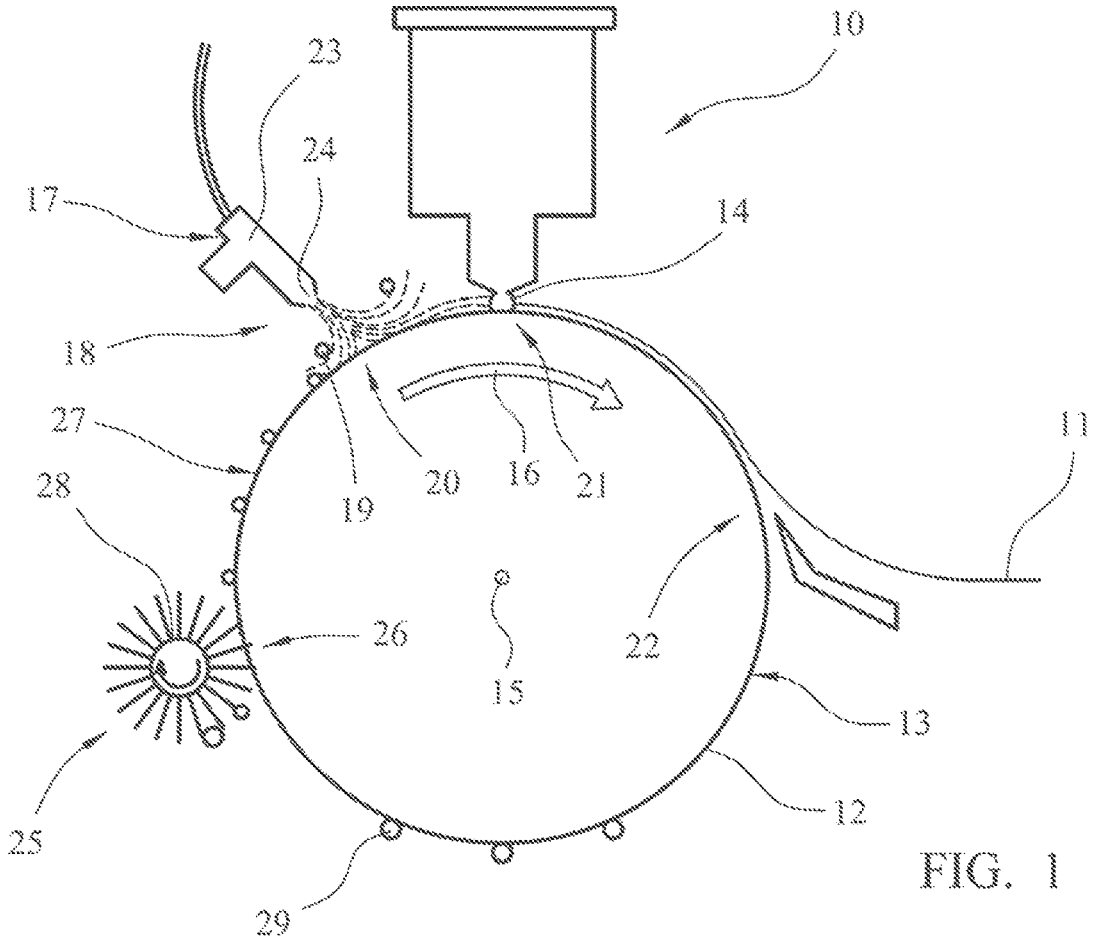
FIG. 1 shows a schematic representation of an apparatus for producing a metallic strip using a rapid solidification technology according to a first embodiment.

FIG. 1 shows a schematic representation of an apparatus 10 for producing a metallic strip 11 using a rapid solidification technology according to a first embodiment.

The apparatus 10 has a rotating casting wheel 12 with an outer surface 13 onto which a melt 14 is cast. The casting wheel 12 can also be described as a heat sink and in the apparatus shown rotates about an axis 15 in a direction of rotation indicated by the arrow 16. The melt 14 solidifies on the outer surface 13 of the casting wheel 12 and the metal strip 11 is formed. The solidification rate of the melt 14 is typically very high and the melt 14 therefore solidifies as an amorphous strip 11.

The apparatus 10 also has means 17 for directing a $CO_2$-containing jet 18 onto the outer surface 13 of the casting wheel 12. The jet 18 comprises $CO_2$. At least part of the $CO_2$ strikes the moving outer surface 13 of the casting wheel 12 in a solid state such that the outer surface 13 of the casting wheel 12 is worked and/or cleaned by the jet 18. FIG. 1 shows solid particles 19 of $CO_2$. These solid particles 19 may be either prefabricated dry ice particles or formed from liquid $CO_2$ immediately upstream of the outer surface 13.

The jet 18 strikes the outer surface 13 of the casting wheel 12 at a first position 20 that is arranged, when viewed in the direction of rotation 16, upstream of a second position 21 at which the melt 14 strikes the outer surface 13. When viewed in the direction of rotation, this first position 20 is arranged downstream of the point 22 at which the strip 11 detaches from the casting wheel 12. As a result, once the strip 11 has detached from the outer surface 13, the outer surface 13 is worked and cleaned by the $CO_2$ jet 18 before the melt 14 strikes this region of the outer surface 13 again.

The melt 14 and so the strip 11 may have different compositions. In one embodiment the melt 14 comprises: $Fe_{100-a-b-w-x-y-z}\,T_a\,M_b\,Si_w\,B_x\,P_y\,C_z$ (in at %), T denoting one or more elements in the group consisting of Co, Ni, Cu, Cr and V, and M denoting one or more of the elements in the group consisting of Nb, Mo and Ta, where $0 \le a \le b$ 70

$0 \le b \le 9$ $0 \le w \le 18$ $5 \le x \le 20$ $0 \le y \le 7$ $0 \le z \le 2$.

The melt may also contain up to 1 at % impurities.

In one embodiment the means 17 for directing a $CO_2$-containing jet 18 onto the outer surface 13 of the casting wheel 12 comprises a jet device 23 with one or more nozzles 24. The width of the jet nozzle 24 can be adjusted to the width of the metal strip 11 to be produced such that the jet 18 covers the complete casting track. However, the jet gun 23 can also be moved axially over the casting wheel 12 so that its spray jet travels over the casting track at certain points. The blasting device directs a jet of $CO_2$ in a solid state onto the outer surface 13 and so blasts it.

In some embodiments the apparatus 10 also has one or more additional surface-working means 25. These further surface-working means 25 can work the outer surface 13 using a forming process, e.g. rolling, or using a material-removing process, e.g. polishing. In the embodiment shown in FIG. 1 a brush is provided as the surface-working means 25.

This surface-working means 25 is arranged at a third position 26 on the casting wheel 12, wherein when viewed in the direction of rotation 16 this third position 26 is arranged upstream of the first position 20 at which the jet 18 comprising solid $CO_2$ 19 strikes the outer surface 13, but downstream of the point 22 at which the strip 11 detaches from the casting wheel 12. As a result, once the strip 11 has detached the outer surface 13 is first worked with the surface-working means 25 in order to remove large particles 29 from the outer surfaces 13, then worked with the $CO_2$-containing jet 18 in order to remove residues 27, and only then is the melt 14 cast onto the outer surface 13 against. This sequence makes it possible for the $CO_2$-containing jet 18 to remove residues 27 from the material-removing processes carried out on the outer surface 13, e.g. particles of the casting wheel itself, polishing agents, etc., or residues from forming processes carried out on the outer surface 13, e.g. lubricant.

For example, the surface-working means 25 may be a rolling device that is pressed against the outer surface 13 of the rotating casting wheel 12 as the outer surface 13 of the casting wheel 12 moves and/or a grinding device that is pressed against the outer surface 13 of the rotating casting wheel 12 as the outer surface 13 of the casting wheel 12 moves and/or a polishing device that is pressed against the outer surface 13 of the rotating casting wheel 12 as the outer surface of the casting wheel 12 moves, and/or have one or more brushes 28 that are pressed against the outer surface 13 of the rotating casting wheel 12 as the outer surface 13 of the casting wheel 12 moves.

If material-removing and forming working methods are used in one apparatus 10, the outer surface 13 may first be worked using the material-removing working method, then using the forming working method and then using the $CO_2$-containing jet 18.

The casting-wheel surface 13 has good thermal conductivity and so causes the very rapid solidification of the melt 14 applied to it, thereby creating a strip 11 that has particular mechanical, physical and/or magnetic properties due to its specific structure and/or composition. The outer surface 13 of the casting wheel 12 may be made of copper or a copper-based alloy.

According to the invention, the casting wheel 12 is worked and cleaned using solid $CO_2$ during strip production. With a $CO_2$-containing jet in which at least part of the $CO_2$ is in a solid state, particles can be removed from the casting track and adhering oils and other layers on the casting track that *impar* wetting can also be removed, whereby its own residues, i.e. the $CO_2$ gas created by sublimation, even having an advantageous effect on the production of many amorphous alloys.

In one embodiment the casting wheel 12 is worked by dry ice jets during strip production. The blasting of the casting-wheel surface 13 with dry ice is carried out during the casting process, between a polishing station and the molten metal droplet, for example. This dry ice blasting removes impurities on the casting track that impair wetting as well as residues from the polishing process such as copper dust from the casting wheel material, abrasive grains, organic impurities, oils, etc.

Figure 2:
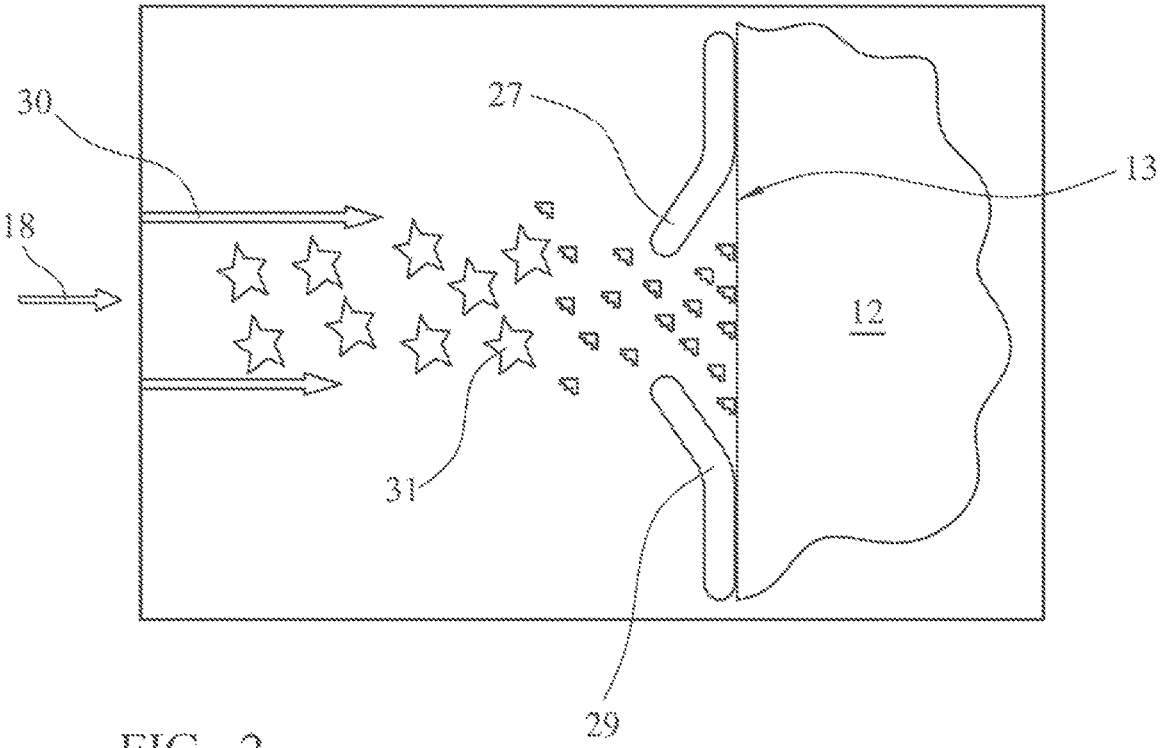
FIG. 2 shows a schematic representation of a $CO_2$-containing jet for working a surface.

FIG. 2 shows a schematic representation of the working of the outer surface 13 of the casting wheel 12 with $CO_2$ snow jets. In $CO_2$ snow blasting, liquid $CO_2$ 30 from a pressurised cylinder is sprayed onto the surface 13 to be treated via a nozzle system. The expansion of the pressurised liquid $CO_2$ 30 creates small, highly dispersed ice crystals 31 or $CO_2$ snow that strikes the surface 13 with high kinetic energy, as illustrated in FIG. 2. In this arrangement, the nozzle system may comprise single-substance ($CO_2$ only) or dual-substance nozzles (i.e. with the addition of compressed air). The $CO_2$ particles 31 in the jet 18 sublime both before and after the jet 18 strikes the outer surface 13 so that the residues 27 and other particles 29 are carried across the outer surface 13 and removed from the outer surface 13.

The sublimation of the dry ice particles 19 or the snow 31 on the casting-wheel surface 13 creates a $CO_2$-containing atmosphere upstream of the molten metal droplet, which is very advantageous for the wetting of ferrous molten metals and the reduction of air pocket size on the underside of the strip. It also directly cools the surface 13 of the casting track, which is advantageous for the rapid solidification of the molten metal 14 on the casting wheel 12.

The residues 27 and particles 29 can be removed by the jet comprising solid $CO_2$ by the effect of pulse transmission, the creation of mechanical stresses due to the abrupt differences in temperature, a solvent effect created by the change of aggregation state when the jet strikes the surface, and sublimation pulsed washing that takes place with sublimation due to the great increase in volume, e.g. a 600× to 800× increase in volume.

The use of the cleaning method also achieves the secondary cooling of the casting track. During casting, depending on the temperature of the molten metal being cast and once the primary cooling has been carried out and adjusted, the casting wheel, which is normally fitted with a water cooling system beneath the surface (referred to here as primary cooling), has a surface temperature of approx. 100° C.-500° C. on the casting track. With primary water cooling during continuous casting, lower surface temperatures are very difficult, not to say impossible, to achieve with large strip widths or larger formed metal strip thicknesses. By using cold dry ice at −80° C. directly on the surface of the casting track it is possible to further reduce the surface temperature of the casting track resulting from the primary cooling during casting, which can be very advantageous for some alloys. Dry ice can also be used to cool the metal strip produced directly.

The only residue remaining after the cleaning process is an increased $CO_2$ content in the surrounding atmosphere, which can actually be used to improve the quality of the amorphous metal strip to be produced. An improvement in quality due to the increased $CO_2$ content can be achieved by the use of dry ice in the cleaning process.

Figure 3:
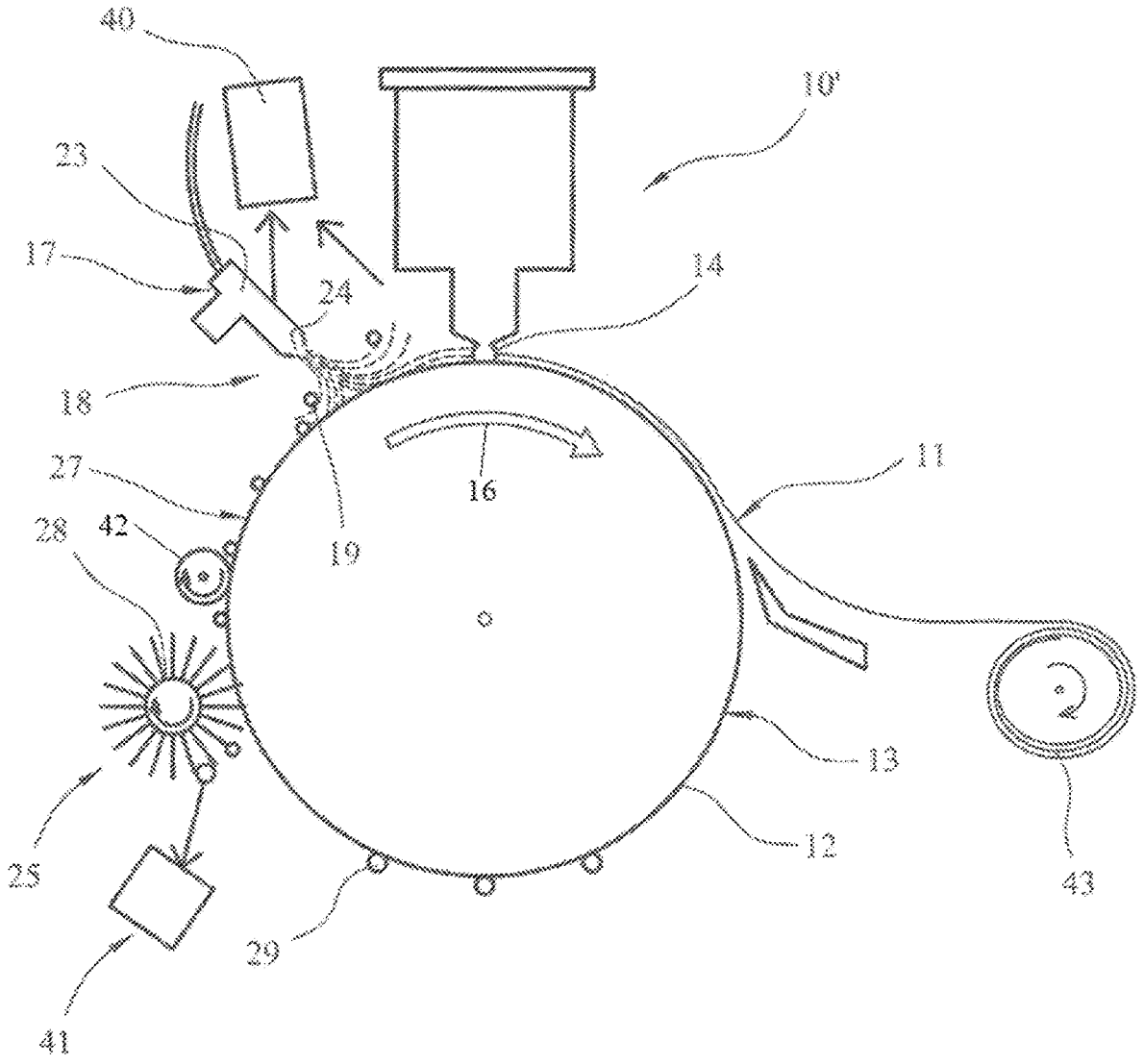
FIG. 3 shows a schematic representation of an apparatus for producing a metallic strip using a rapid solidification technology according to a second embodiment.

FIG. 3 shows a schematic representation of apparatus 10' according to a second embodiment. The apparatus 10' also has an exhaust system 40 for removing $CO_2$ gas. This makes it possible to ensure that the atmosphere in the proximity of the apparatus meets the applicable environmental and industrial safety standards.

The apparatus 10' also has an extraction system 41 for removing the material detached from the outer surface of the casting wheel in order to prevent this detached material from landing on the outer surface again.

In addition to the brush 28 that forms the surface-working means 25, the apparatus 10' also has a rolling device 42 as the second surface-working means 25 that forms the outer surface 13 of the casting wheel 12. When viewed in the direction of rotation 16, the rolling device is arranged downstream of the brush 28 and upstream of the $CO_2$-containing jet 18. FIG. 3 also shows a winder 43, which continuously takes up the solidified metal strip.

During casting, the casting-wheel surface is subject to very high mechanical and physical loads. For example, the local application of a very hot molten metallic mass (approx. 900 . . . 1500° C.) in the regions close to the surface results in high temperature peaks and extreme temperature gradients. During further cooling, the strip shrinks both longitudinally and transversely. High shear stresses occur between the strip and the heat sink surface, resulting in relative movements, and the strip either tears off the surface spontaneously or is torn off it by force at the detachment point.

These processes are repeated thousands and even some tens of thousands of times during a casting process and so constantly change the surface of the cooling drum. This causes signs of wear caused by thermal and mechanical stresses, such as material fatigue, surface roughness and pitting, which can in turn have negative repercussions on the rapidly solidified strip to be produced.

The efficiency of this production process is therefore very heavily dependent on mastering wear processes. Much can be done in advance to reduce the occurrence of these undesired side effects by selecting the appropriate material, production process and surface-working method, but they cannot be entirely excluded. According to the invention, the outer surface of the casting wheel is therefore worked with a $CO_2$-containing jet, the jet comprising $CO_2$ in a solid state such that particles of solid $CO_2$ strike the outer surface at a specific speed.

In addition to preventive measures, it is also possible to use directly acting processes that counter wear mechanisms during the production process. Known processes of this type are, in particular, abrasive processes such as brushing, grinding, polishing, etc. However, these processes can result in significant undesirable side effects (e.g. dust formation, residues, impurities, etc.) and ultimately cause wetting defects and tears.

There are also other external influences that affect the production process. One significant factor in this context is surface contamination by residues, deposits and/or the formation of condensation resulting from the environment and the processes used. They impair wetting in the molten metal and so adversely affect cooling, geometry and the properties of the strip produced. The main causes can be volatile alloy components (B, C, Sn, etc.), volatile components of fireproof materials (resins, etc.), debris from the wiper, for example, and residues from surface wear and the finished strip.

A highly effective cleaning process is thus carried out close to the casting nozzle, reliably removing any impurities whilst not itself having any adverse effect on the casting process.

In the rapid solidification technology (melt spinning) required for the production of amorphous strips, a glass-forming metal alloy is melted in a crucible that is typically made substantially of an oxidic ceramic (e.g. aluminium oxide) and/or graphite. Depending on the reactivity of the melt, the melting process may take place in air, in a vacuum or in an inert gas such as argon. Once the alloy has been melted down to temperatures well above the liquidus point, the melt is transported to a casting tundish and injected through a casting nozzle, which generally has a slit-shaped outlet opening, onto a rotating wheel made of a copper alloy. To this end, the casting nozzle is brought very close to the surface of the rotating copper drum and sits at a distance of approx. 50-500 μm from it during the casting process. The melt passes through the nozzle outlet and strikes the moving copper surface, where it solidifies at cooling rates of approx. $10^4$ K/min to $10^6$ K/s. The rotational movement of the drum carries the solidified melt away from the cooling drum as a continuous strip band, detaches it from the cooling drum and winds it onto a winding device as a continuous band strip. As a general rule, the maximum possible length of the strip band is limited by the holding capacity of the crucible, which can range from a few kilogrammes to several tonnes depending on the size of the apparatus. When operating with a plurality of crucibles in parallel, it is even possible to achieve an almost continuous supply of molten metal to the casting tundish. The scale of apparatus in which commercially available amorphous strips are economically manufactured typically has crucible sizes of greater than 100 kg. Given a strip cross section with a strip width of approx. 100 μmm and a strip thickness of approx. 0.018, 100 kg of the alloy VITROPERM 500 results in a strip length of approx. 8 km. In an industrial process, a full crucible therefore produces a length of tens of kilometres and, if the casting process involves the regular refilling of a tundish in a continuous casting method, in a significantly greater number of kilometres.

The wear on the casting-wheel surface during the uninterrupted casting process results in increased surface roughness of the wheel surface and, in turn, in the formation of cavities or uneven structures that both transport process gas beneath the molten metal droplet and cause larger gas bubbles in the contact region between the molten metal droplet and the casting wheel. When the molten metal solidifies, these gas bubbles are frozen in the amorphous strip and can lead to hole-like defects, particularly in thin strips. This wheel roughness is also carried through to the surface of the strip that is produced on it such that the strips produced on it also show increased roughness.

In order to minimise wear on the casting wheel it is desirable to select a high-strength casting-wheel material. In the metallurgical copper materials generally used, the properties of strength and heat conductivity tend to act in opposite directions. A copper material with maximum possible heat conductivity will always have a lower strength than more highly alloyed copper materials. Higher alloyed copper materials are generally stronger but are associated with lower conductivity. However, the production of amorphous metal strips requires the use of casting-wheel materials with relatively high thermal conductivities in order to achieve sufficiently high cooling rates during strip production. If the cooling rates are not sufficiently high, the strips become brittle or partially brittle, form undesirable crystalline structures, e.g. a level of surface crystallinity, and so cannot be wound continuously in the casting process or tear off during winding, resulting in undesirably low productivity in strip production. It is desirable to use casting-wheel materials with a thermal conductivity of greater than 200 W/mK. However, such materials have a hardness of less than 250 HV (HV30)

In order to be able to use these relatively soft and highly thermally conductive materials in the casting of amorphous strips in the long term it is also necessary to ensure that the contact surface between the molten metal/strip and the casting wheel, i.e. between the casting track and the casting-wheel surface, is worked evenly during strip production and to keep the roughness of the wheel surface at a constant and uniformly low level. This can be achieved by material-removing processes such as polishing or polishing the drum or by means of brushes.

Rotating metal brushes can be used to remove residues on the casting drum that impair wetting. However, these rotating brushes may leave residues in the form of detached brushes that can result in local defects on the strip and to frequent tears in the strip during strip production.

The use of even coarser brushes leads to tears in the thin strip on the casting wheel. Although the invention describes a vacuum source designed to reliably aspirate any removed items and dust, the extraction of dust on fast rotating casting wheels has not proved reliably practicable. There are always some minute dust residues left adhering to the casting wheel, resulting in imperfections in the strip.

The polishing of the casting wheel using emery paper or a rotating polishing substrate can also be used as the surface-working process. However, a polishing material of this type produces a small amount of dust that can result in defects in the strip.

Non-abrasive forming processes such as the rolling of the casting drum should be advantageous. Although forming processes have the advantage that they leave no polishing material residues on the casting drum, the fast-rotating tools used for surface forming at the pivot and bearing points are lubricated and minute particles of the lubricant reach the wheel surface where they can impair wetting and so result in the formation of holes in the strip.

It cannot be excluded that working residues (dust, brush hairs, polish residues, grease, oil, organic material) are carried into the molten metal droplet, where they may cause imperfections. None of the prior art teach how such working residues can be removed, i.e. how either solid particles such as abrasive dust, polishing material grains and brush hairs or adhering organic residues of oils or polishing agents can be reliably removed.

In one embodiment dry ice blasting is used. Dry ice blasting is a compressed-air blasting process in which solid carbon dioxide at a temperature of approx. −79° C., so-called dry ice, is used as the blasting medium. The process is used in surface technology for cleaning and deburring.

Dry ice is electrically non-conductive, chemically inert, non-toxic and non-combustible. In contrast to other blasting media, dry ice passes directly from a solid to a gaseous state at ambient pressure without liquifying, i.e. it sublimes.

For cleaning, dry ice particles are blasted at a rate of 5000 litres of air per minute, for example, and strike the material to be cleaned at the speed of sound. This locally supercools and embrittles the layer to be removed. Subsequent dry ice particles penetrate the brittle fissures and sublime abruptly on impact. The carbon dioxide becomes gaseous, increasing its volume approx. 700× to 1000×, causing the debris or deposit to split off the surface.

The advantages of this minimally abrasive process lies in the low level of damage or change to the surface to be cleaned and in the fact that no solid or liquid cleaning medium remains on the surface after working.

Since dry ice is relatively soft, it does not damage the surfaces of the casting wheels. Dry ice blasting can be used to remove paint, rubber, oil, grease, silicon, wax bituminous coatings, releasing and binding agents and adhesives. In the use of dry ice blasting on the casting wheel according to the invention we also use the high kinetic energy of the blasted dry ice particles to remove solid polishing residues such as copper dust or solid abrasive residues or brush hairs from the casting track and so prevent these working resides from impacting the molten metal droplet.

Compressed air at a pressure of 0.5 to 25 bar can be used as the carrier gas for the dry ice particles. In an alternative embodiment $CO_2$ snow blasting is used. $CO_2$ cleaning takes place during strip production.

In a further embodiment the compressed air-dry ice mixture is added to a further blasting medium such as glass beads, corundum, nutshells or plastic granulate, for example. This achieves the same cleaning results as conventional abrasive blasting (sand blasting). Since dry ice is a soft blasting medium (2-3 Mohs), in some embodiments it is also possible to use the additional harder blasting media to remove stubborn impurities such as paint on steel, corrosion pitting in steel, patina on metals, etc.

In a further embodiment $CO_2$ snow blasting jets are used as the $CO_2$-containing jet to reliably remove particulate and adhesive impurities without no adverse effect on the casting process.

In $CO_2$ snow blasting liquid $CO_2$ from pressurised cylinders is sprayed via a nozzle system onto the surface to be treated. The expansion of the pressurised liquid $CO_2$ creates small, highly dispersed ice crystals (snow) that strike the surface, as illustrated in FIG. 2. The nozzle system may comprise single-substance nozzles ($CO_2$ only) or dual-substance nozzles (i.e. with the addition of compressed air).

$CO_2$ snow blasting is used for effective inline cleaning in melt spinning processes. $CO_2$ snow blasting is the ideal process for the continuous cleaning of the surface of the cooling drum during the casting process. It can be used both on its own and in conjunction with a further wear-reduction process.

The process is typically used on its own when wear mechanisms are of minor significance to ensure that the outer surface of the casting wheel is adequate throughout the casting process. Certain alloy systems (e.g. Cu-based alloys) cause only negligible signs of wear on the surface of the cooling drum. However, condensate deposits, strip residues and fine abrasion dust (for the wiper, for example) can lead to wetting defects that have a significant negative effect on strip quality and can lead to breaks. They can be removed using the blasting jet containing solid $CO_2$.

Snow blasting can also be used in conjunction with any other casting-wheel conditioning process. With forming processes (such as rolling) it offers an additional cleaning effect; with material-removing processes (such as brushing, polishing, polishing, etc.) it also helps remove any dust or other abrasive residues that may occur.

If, in addition, the $CO_2$ nozzles are arranged close to the casting nozzle, an air displacement effect means that it is also possible to positively influence wetting and the solidification rate in the region of the molten metal.

As already described, $CO_2$ snow blasting is a dry residue- and solvent-free process that requires no subsequent treatment of the worked surface. It can easily be adapted to existing processes and apparatuses and adjusted to process parameters. If the relatively high air concentration limits are respected when it is used, it is can also be used in conjunction with electricity, molten metal, fire and water in complete safety.

The invention claimed is:

1. A metallic strip consisting of:

$Fe_{100-a-b-w-x-y-z}\ T_a\ M_b\ Si_w\ B_x\ P_y\ C_z$ (in at %) and up to 1 at % impurities, T denoting one or more elements in the group consisting of Co, Ni, Cu, Cr and V, and M denoting one or more of the elements in the group consisting of Nb, Mo and $T_a$, where $0 \leq a \leq 70$ $0 \leq b \leq 9$ $0 \leq w \leq 18$ $5 \leq x \leq 20$ $0 \leq y \leq 7$ $0 \leq z \leq 2$, having at least one surface (16) with an average surface roughness $R_a$ of between 0.05 μm and 1.5 μm, wherein the metallic strip is amorphous or nanocrystalline, the metallic strip having a casting-wheel side that has been solidified on an outer surface of a casting wheel, an opposing air side and a structure that is at least 80% by volume amorphous or that has at least 80% by volume nanocrystalline grains and an amorphous residual matrix in which at least 80% of the nanocrystalline grains have an average grain size of less than 50 nm and a random orientation, and the air side and/or the casting-wheel side having a surface crystallisation proportion of less than 23%.

2. A metallic strip according to claim 1, wherein the surface roughness $R_a$ has a deviation of less than +/−0.2 μm over a production length of at least 5 km.

3. A metallic strip according to claim 1, which has a technically clean surface free from organic and inorganic residues on the casting-wheel side immediately after detaching from the casting wheel.

4. A metallic strip according to claim 1, which has a width of 2 μmm to 300 μmm, a thickness of less than 50 μm and a maximum of 50 holes per square meter.

5. A metallic strip according to claim 1, which has a width of 20 μmm to 200 mm and/or a thickness of between 10 μm and 18 μm and/or fewer than 25 holes per square meter.

* * * * *